United States Patent [19]

Sundheimer

[11] Patent Number: 4,870,927

[45] Date of Patent: Oct. 3, 1989

[54] DEVICE FOR PREVENTING THERMAL STRATIFICATION IN A STEAM GENERATOR FEED PIPE

[75] Inventor: Patrick Sundheimer, Saint Maur des Fosses, France

[73] Assignee: Framatome, Courbevoie, France

[21] Appl. No.: 213,564

[22] Filed: Jun. 30, 1988

[30] Foreign Application Priority Data

Jun. 30, 1987 [FR] France ..... 87 09219

[51] Int. Cl.[4] ..... F22B 37/22

[52] U.S. Cl. ..... 122/412; 122/235 F; 251/118; 376/277

[58] Field of Search ..... 376/277; 251/118; 122/235 F, 412

[56] References Cited

FOREIGN PATENT DOCUMENTS 0045034 2/1982 European Pat. Off. .
0210895 2/1987 European Pat. Off. .
0216667 4/1987 European Pat. Off. .
2157407 10/1985 United Kingdom .

*Primary Examiner*—Arnold Rosenthal
*Attorney, Agent, or Firm*—Pollock, Vande Sande & Priddy

[57] ABSTRACT

Device for preventing thermal stratification for a steam generator feed pipe. A fixed helix (14) downstream of a rising break (12) of the pipe subdivides its interior into twisted channels. The cold water entering at a low flame rate is blocked upstream until a predetermined height (h) is reached and completely fills an upstream part (11) to be protected against thermal gradients.

6 Claims, 1 Drawing Sheet

FIG. 1
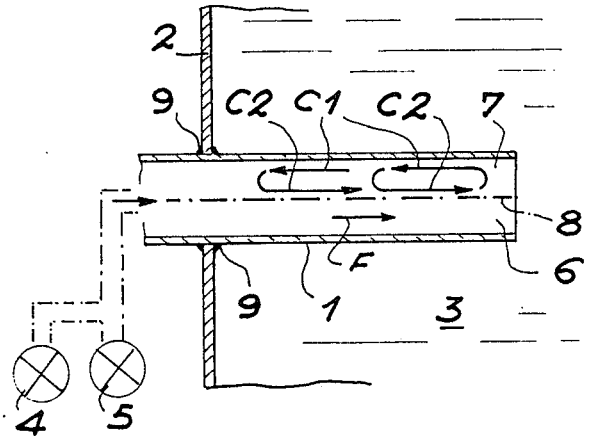
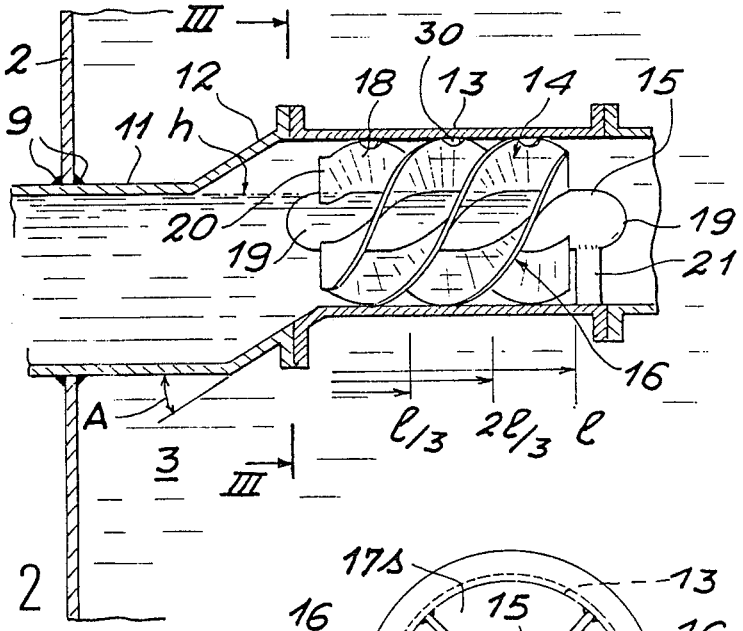
FIG. 2
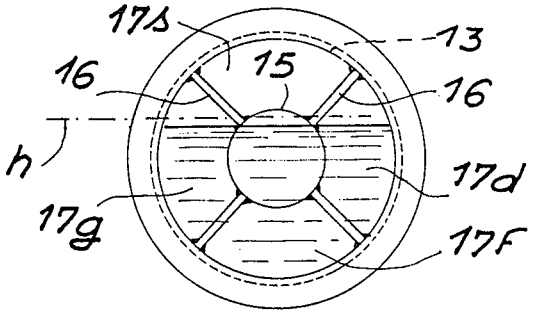
FIG. 3

DEVICE FOR PREVENTING THERMAL STRATIFICATION IN A STEAM GENERATOR FEED PIPE

FIELD OF THE INVENTION

The present invention relates to a device for preventing nthermal stratification in steam generator feed water pipes, and more particularly pressurized water steam generators used in nuclear power stations.

BACKGROUND OF THE INVENTION

The steam generators of such power stations frequently have a ring-shaped distributor, whose shape is like a vertically axed torus or with lobes and which is supplied by a substantially horizontal pipe. During the normal operation of the reactor, the free surface of the water in the enclosure is located above the pipe and the distributor and the water speed in the pipe is relatively high. Operation is then satisfactory. However, it can be disturbed under exceptional, temporary conditions of various types.

One problem is caused by the thermal stratification of the feed water when operating under very low loading conditions. This phenomenon is more particularly described in the article "Loading conditions in horizontal feed water pipes of LWRs influenced by thermal shock and thermal stratification effects", by M Miksch et al, NUCLEAR ENGINEERING AND DESIGN, 84, 1985, pp 179–187. This phenomenon is aggravated in the case of steam generators equipped with a single feed means for the water, which is under normal loading conditions, but in the case of an accident or problem it is under very low loading conditions. In the latter situation, a small feed water flow is injected into the pipe full of water at the operating temperature of the steam generator. As the flow rate is low, the cold water does not mix with the hot water and instead forms a separate layer at the bottom of the pipe. This stratification maintains a high temperature gradient between the upper and lower parts of the pipe wall, which leads to thermal stresses of the type liable to cause cracking, including in the weld joining the pipe to the enclosure. This phenomenon is aggravated by the fatigue caused by vibrations of the interface between the layers.

Curved pipes which are supposed to assist the accumulation of cold water in a lower level upstream part where the areas to be protected are located do not significantly reduce this stratification phenomenon, which would seem to indicate that it is helped more particularly by the heat exchange resulting from the natural convection between the hot water occupying the balloon-shaped means and the interior of the pipe. Various attempts have been made to eliminate this stratification. One consists of introducing feed water into the pipe via an annular spill port issuing into a water box where a certain amount of mixing takes place. It has also been proposed to provide on the inner face of a bend or elbow of the pipe, an annular or spiral projection of limited height, in order to increase the turbulence of the flow. Such a device has only very limited effectiveness. Thus, when the flow rate is low, i.e., when a mixture is sought, the stream of feed water merely passes round the obstacle thus formed.

SUMMARY OF THE INVENTION

The present invention is designed to eliminate this stratification problem in steam generator feed pipes by using simple means, which only lead to a limited flow pressure drop and which are purely of a static nature.

It is characterized by the combination of an upward break, constituted by a double bend, in the supply pipe and a helix serving to both partly block the cold water so that it fills the entire part of the pipe where stratification is to be prevented before allowing it to flow into the generator, and to act as a barrier to the reverse flow of hot water.

More specifically, the invention relates to a fixed helix located downstream of an upward break in the supply pipe, which is itself downstream of an area of the feed pipe wher thermal stratification is to be prevented, the fixed helix being constituted by a central hub and blades joining the hub tot the feed pipe, the blades forming at least a half-turn around the hub and defining twisted channels arranged in such a way that the feed water flowing by gravity in the channels, only flows downstream of the helix after having entirely filled the feed pipe upstream of the break.

The break is advantageously constituted by two horizontal parts of the feed pipe connected by a median part, with an obliquity of approximately 30°, of said feed pipe.

BRIEF DESCRIPTION OF THE DRAWINGS

The invention is described in greater detail hereinafter relative to embodiments thereof and the attached drawings.

FIG. 1 shows the phenomenon to be prevented by the invention.

FIG. 2 shows an embodiment of the invention in the form of a longitudinal section through a feed pipe.

FIG. 3 is a secttion view along line III—III of FIG. 2.

DESCRIPTION OF PREFERRED EMBODIMENT

FIG. 1 shows a conventional feed water pipe 1 passing through the steam generator envelope 2, to which it is joined by welds 9, to the interior thereof in order to issue intot a feed torus (not shown). The feed pipe 1 can be connected to two separate supplies or feeds. A hot water supply 4 is used under normal operating conditions and the flow is then relatively high in order to entirely fill the feed pipe 1. However, when a second, cold water supply 5 is used for cooling the interior 3 of the steam generator, this generally occurs at a low flow rate, so that the cold water circulates in the direction of arrow F in the form of a layer 6 in the lower part of feed pipe 1, while being surmounted by a residual hot water layer 7 with a lower density, which is maintained in the feed pipe 1.

The two layers 6 and 7 do not mix and there is no equalizing of their temperatures, due to a permanent renewal or replenishment of the hot water in feed pipe 1. The hot water flows in the direction of arrow C1 towards the upstream side thereof through the top of the residual layer 7 before being moved downstream, in the direction of arrow C2, under the action of the flow of the cold water layer 6. This leads to a high temperature gradient at the interface 8 between the cold and hot water layers 6, 7 respectively, so that there are sudden expansion variations to the feed pipe 1 at this height and consequently high shear stresses, particularly close to the wels 9 where the deformation possibilities are further reduced. Fatigue fractures have been noted at this point, due to the aforementioned thermal stratification phenomenon which is to be prevented.

As shown in FIG. 2, the feed pipe according to the invention is in three parts, namely an upstream part 11 passing through envelope 2, a downstream part within envelope 2 and which issues onto the feed torus, and a median part 12 connecting the two aforementioned parts.

The upstream Part 11 and the downstream part 12 are horizontal, the downstream part being located at a somewhat higher level. They constitute an upward vertical break or detachment. The median part 12 is oblique and forms an angle A with respect to the horizontal, which angle is so chosen as not to create an excessive pressure drop, and case (FIG. 3), and which join the hub 15 to the downstream.

A fixed helix 14 is located in downstream part 13. It is formed by a long cylindrical hub 15, whose axis is parallel to that of the downstream part 13, as well as blades 16, whereof there are four in the present case as can be seen in FIG. 3 and which join the hub 15 to the downstream part 13. Blades 16 extend over the entire length of hub 15 and are spirally twisted in such a way as to cover a three-quarter turn in the pipe. They can be identical and angularly distributed at regular intervals. Two adjacent blades 16, the hub 15 and the pipe downstream part 13 define channels 17, whose section is an angular ring sector. The channels 17 are twisted as a result of the spiral shape of the blades 16.

In the embodiment described here, the end 18 of blades 16 closes to the median part 12 (i.e., the upstream end) is oriented at 45° from the horizontal. Thus, it is possible to see in FIG. 3 an upper channel **17*s* above the hub 15 at this location, a lower channel 17*f* opposite thereto with respect to hub 15, and left-hand and right-hand lateral channels 17*b* and 17*d* which are opposite to one another. The water flowing downstream, i.e., towards the right in FIG. 2, passes through the helix 14 and in the interior of channels 17**.

With the presently described helix 14, each channel 17 has a section above the hub 15, the upper channel **17*s* at the inle of helix 14, the right-hand lateral channel 17*d* at one-third of its length, the lower channel 17*f* at two-thirds of its lengtth and the left-hand lateral channel 17*g*** at the oulet (abscissas ⅓, 21/3 and 1, respectively, shown in FIG. 2).

The protective device functions as follows. When cold water is supplied, as shown in FIG. 1, it first penetrates the lower part of the pipe and reaches helix 14. It progressively penetrates the lower channels and then the lateral channels **17*f*, 17*g* and 17*d*, but cannot clear these because they all have a section at a higher level than their inle section, so that the cold water accumulates upstream of helix 14 and its level progressively rises. This situation lasts until the cold water reaches the height h corresponding to the lowest point of ochannel 17*s*, whose section has a height which constantly decreases from the inlet section, the remainder of the pipe when being filled with hot water. The cold water then starts to pass through the upper channel 17*s*, which has a descending slope and consequently enables it to flow freely beyond helix 14**.

It is thus ensured tha a minimum cold water height is formed, no matter how low its supply flow rate, upstream of helix 14. This height may be exceeded under permanent operating conditions, if the flow rate is adequate. The protection of the upstream part 11 of the pipe against thermal gradients is obtained if the latter is positioned entirely below height h, because the hot water is progressively forced back therefrom. The helix simultaneously makes it possible to block towards the upstream side the hot water convection currents.

Thus, a implementation of the invention is dependent on the compatibility of the helix 14 and the break created by means of the median part 12. Generally, each channel 17 defined by the blades 16 of helix 14 must have a section which is located entirely above the upstream part 11 of the feed pipe to be protected. At least one hole 30 is provided in the upper part of a blade 16, thus making it possible to place all the channels under the same pressure.

It is possible to modify the number of blades 6 and their particular, it is possible to modify the number of blades 6 and their winding around hub 15. However, a winding of less than a half-turn would not be realistic.

Several measures can be taken to limit pressure drops through helix 14. It is first of all possible to provide hub 15 with fusiform, rounded or tapered ends 19, which make it possible for the water to pass more easily round it, both at the upstream and downstream sides. The upstream end 18 of the blades can also be completed by a longitudinal leading edge 20, which more easily separates the fluid steams on either side and assists their entry into the channels 17.

With regards to the specific construction, helix 14 can be welded to the downstream part 13 by a spacer 21 at the end of hub 15, after which the clearance between the blades 16 and the downstream part 13 is filled by, e.g., welding or brazing.

The device has a simple construction and is reliable for solving the thermal stratification problem. It differs both from curved pipes used in isolation to move the parts to be protected away from the hot point constituted by the steam balloon at the top of the interior of the envelope and limit the penetration depth towards the upstream side of the hot water convection currents, and from mixing devices aimed at mixing the hot and cold currents, which have always been less successful.

I claim:

1. Device for preventing thermal stratification for a steam generator feed pipe (11, 12, 13), said device comprising a fixed helix (14), located downstream of an upward break of said feed pipe, which is itself downstream of an area of said feed pipe (11) where thermal stratification is to be prevented, said fixed helix 14 being constituted by a central hub (15) and blades (16) joining said hub (15) to said feed pipe (13), said blades (16) forming at least one half-turn around said hub (15) and defining twisted channels (17) so arranged that feed water, flowing by gravity in said channels, flows downstream of said helix (14) only after having entirely filled said feed pipe (11) upstream of said break.

2. Device according to claim 1, wherein said stream generator comprises an envelope (2) which is traversed by said feed pipe, said break (12) and said helix (14) being located in said envelope.

3. Device according to claim 1, wherein said break (12) comprises two horizontal parts (11, 13) of said feed pipe connected by a median part (12) inclined at an angle to the horizontal of approximately 30°.

4. Device according to claim 1, wherein said blades (16) have an end part (20) located towards said break and positioned longitudinally with respect to said feed pipe.

5. Device according to claim 1, wherein said hub (15) has tapered ends (19).

6. Device according to claim 1, wherein at least one of said blades (16) has a hole (30) in an upper part thereof.

* * * * *